US007534100B2

(12) United States Patent
Masuda

(10) Patent No.: US 7,534,100 B2
(45) Date of Patent: May 19, 2009

(54) ROTARY FLUID MACHINE

(75) Inventor: Masanori Masuda, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 32 days.

(21) Appl. No.: 10/573,889

(22) PCT Filed: May 11, 2005

(86) PCT No.: PCT/JP2005/008637

§ 371 (c)(1),
(2), (4) Date: Mar. 29, 2006

(87) PCT Pub. No.: WO2006/006297

PCT Pub. Date: Jan. 19, 2006

(65) Prior Publication Data

US 2007/0036666 A1 Feb. 15, 2007

(30) Foreign Application Priority Data

Jul. 9, 2004 (JP) ..... 2004-203665

(51) Int. Cl.
*F04C 18/00* (2006.01)

(52) U.S. Cl. ..... 418/59; 418/62; 418/63; 418/64

(58) Field of Classification Search ..... None
See application file for complete search history.

(56) References Cited

U.S. PATENT DOCUMENTS 1,229,676 A * 6/1917 Tice ..... 418/59
1,780,109 A * 10/1930 Berglund ..... 418/57
2,561,280 A * 7/1951 Kampf ..... 418/59
3,125,031 A * 3/1964 Rydberg ..... 418/59
3,125,032 A * 3/1964 Rydberg ..... 418/59
3,369,399 A * 2/1968 Coffman et al. ..... 73/272 R
3,645,653 A * 2/1972 Arnold ..... 418/56
3,829,256 A * 8/1974 Guttinger ..... 418/5
4,606,711 A * 8/1986 Mitsui et al. ..... 418/59
5,011,386 A * 4/1991 Guttinger ..... 418/59
5,165,878 A * 11/1992 Inagaki et al. ..... 418/55.3
6,203,301 B1 * 3/2001 Kim ..... 418/59
6,676,392 B1 * 1/2004 Hwang et al. ..... 418/59

FOREIGN PATENT DOCUMENTS

JP 60-92789 U 6/1985
JP 06-288358 A 10/1994

* cited by examiner

*Primary Examiner*—Thomas Denion
*Assistant Examiner*—Douglas J. Duff
(74) *Attorney, Agent, or Firm*—Global IP Counselors

(57) ABSTRACT

A rotary fluid machine is provided with a cylinder having an annular cylinder chamber, an annular piston and a blade that form a rotation mechanism. The piston is disposed in the cylinder chamber to be eccentric to the cylinder and divides the cylinder chamber into an outer working chamber and an inner working chamber. The blade is arranged in the cylinder chamber to divide each of the working chambers into a high pressure region and a low pressure region. The cylinder and the piston make relative rotations. A width of the cylinder chamber is varied along a circumference of the cylinder chamber such that a gap between a wall surface of the cylinder and a wall surface of the piston is kept to a predetermined value during the rotations. Further, a width of the piston is varied along a circumference of the piston such that the gap between the wall surface of the cylinder and the wall surface of the piston is kept to a predetermined value during the rotations.

16 Claims, 6 Drawing Sheets

ROTARY FLUID MACHINE

CROSS-REFERENCE TO RELATED APPLICATIONS

This U.S. National stage application claims priority under 35 U.S.C. § 119(a) to Japanese Patent Application No. 2004-203665, filed in Japan on Jul. 9, 2004, the entire contents of which are hereby incorporated herein by reference.

TECHNICAL FIELD

The present invention relates to a rotary fluid machine, particularly to measures against a gap that occurs between a cylinder and a piston.

BACKGROUND ART

As a conventional example of a fluid machine, Japanese Unexamined Patent Publication No. H6-288358 discloses a compressor having an eccentric rotation piston mechanism achieved by a cylinder having an annular cylinder chamber and an annular piston which is contained in the cylinder chamber to make eccentric rotation. The fluid machine compresses a refrigerant by making use of volumetric change in the cylinder chamber caused by the eccentric rotation of the piston.

SUMMARY OF THE INVENTION

Problem that the Invention is to Solve

As to the conventional fluid machines, no attention has been paid so far to a gap that occurs between the wall surface of the cylinder and the wall surface of the piston. Therefore, the refrigerant leaks from a high pressure chamber to a low pressure chamber to deteriorate the efficiency.

Specifically, in the above-described fluid machine, an outer compressor chamber and an inner compressor chamber are formed and the direction of application of a load (gas load) by a refrigerant pressure is different between the outer and inner compressor chambers. Nevertheless, the gap between the wall surface of the cylinder and the wall surface of the piston has not been considered at all.

In light of the above, the present invention has been achieved. An object of the present invention is to reduce the gap between the wall surface of the cylinder and the wall surface of the piston, thereby improving the efficiency.

Means of Solving the Problem

Specifically, as shown in FIG. 1, a first aspect of the present invention is directed to a rotary fluid machine including a rotation mechanism (20) including: a cylinder (21) having an annular cylinder chamber (50); an annular piston (22) which is contained in the cylinder chamber (50) to be eccentric to the cylinder (21) and divides the cylinder chamber (50) into an outer working chamber (51) and an inner working chamber (52); and a blade (23) which is arranged in the cylinder chamber (50) to divide each of the working chambers into a high pressure region and a low pressure region, the cylinder (21) and to the piston (22) making relative rotations, wherein the width T1 of the cylinder chamber (50) is varied along the circumference of the cylinder chamber (50) such that the gap between the wall surface of the cylinder (21) and the wall surface of the piston (22) is kept to a predetermined value during the rotations.

According to the first aspect of the present invention, when the rotation mechanism (20) is actuated, the cylinder (21) and the piston (22) make relative rotations. As a result, the volumes of the working chambers (51) and (52) vary to cause compression or expansion of a fluid. As the width T1 of the cylinder chamber (50) is varied along the circumference thereof, the gap that occurs between the wall surface of the cylinder (21) and the wall surface of the piston (22) is reduced to a minimum.

A second aspect of the present invention is directed to a rotary fluid machine including a rotation mechanism (20) including: a cylinder (21) having an annular cylinder chamber (50); an annular piston (22) which is contained in the cylinder chamber (50) to be eccentric to the cylinder (21) and divides the cylinder chamber (50) into an outer working chamber (51) and an inner working chamber (52); and a blade (23) which is arranged in the cylinder chamber (50) to divide each of the working chambers into a high pressure region and a low pressure region, the cylinder (21) and the piston (22) make relative rotations without spinning by themselves, wherein the width T2 of the piston (22) is varied along the circumference of the piston (22) such that the gap between the wall surface of the cylinder (21) and the wall surface of the piston (22) is kept to a predetermined value during the rotations.

According to the second aspect of the present invention, when the rotation mechanism (20) is actuated, the cylinder (21) and the piston (22) make relative rotations. As a result, the volumes of the working chambers (51) and (52) vary to cause compression or expansion of a fluid. As the width T2 of the piston (22) is varied along the circumference of the piston (22), the gap that occurs between the wall surface of the cylinder (21) and the wall surface of the piston (22) is reduced to a minimum.

According to a third aspect of the present invention related to the second aspect of the present invention, the width T1 of the cylinder chamber (50) is varied along the circumference of the cylinder chamber (50) such that the gap between the wall surface of the cylinder (21) and the wall surface of the piston (22) is kept to a predetermined value during the rotations.

According to the third aspect of the present invention, the width T1 of the cylinder chamber (50) is varied along the circumference of the cylinder chamber (50) and the width T2 of the piston (22) is varied along the circumference of the piston (22). Therefore, the gap that occurs between the wall surface of the cylinder (21) and the wall surface of the piston (22) is reduced to a minimum.

According to a fourth aspect of the present invention related to the first or third aspect of the present invention, regarding the center line of the blade (23) as a starting point of the circumference of the cylinder chamber (50), the width T1 of part of the cylinder chamber (50) ranging from the starting point to a point at a rotation angle of 180° from the starting point is small and the width T1 of the other part of the cylinder chamber (50) ranging from the 180° point to a point at a rotation angle less than 360° from the starting point is small.

According to the fourth aspect of the present invention, the gap that occurs between the wall surface of the cylinder (21) and the wall surface of the piston (22) is reduced to a minimum with higher reliability.

According to a fifth aspect of the present invention, the center of the inner circumference of the cylinder chamber (50) is deviated from the center of the outer circumference of the cylinder chamber (50) when viewed in plan.

According to the fifth aspect of the present invention, the cylinder (21) is fabricated easily by merely deviating the inner circumference center and the outer circumference center of the cylinder chamber (50) from each other.

According to a sixth aspect of the present invention related to the first or third aspect of the present invention, the cylinder chamber (50) is divided into four regions along the circumference thereof such that the cylinder chamber (50) has wide regions (Z1, Z3) and narrow regions (Z2, Z4) formed in a continuous and alternate manner.

According to the sixth aspect of the present invention, the gap that occurs between the wall surface of the cylinder (21) and the wall surface of the piston (22) is surely reduced to a minimum at any time during the relative rotations by the cylinder (21) and the piston (22).

According to a seventh aspect of the present invention related to the second or third aspect of the present invention, the blade (23) and the piston (22) make relative swings at a predetermined swing center and regarding the swing center of the blade (23) and the piston (22) as a starting point of the circumference of the piston (22), the width T2 of part of the piston (22) ranging from the starting point to a point at a rotation angle of 180° from the starting point is small and the width T2 of the other part of the piston (22) ranging from the 180° point to a point at a rotation angle of 360° from the starting point is large.

According to the seventh aspect of the present invention, the gap that occurs between the wall surface of the cylinder (21) and the wall surface of the piston (22) is reduced to a minimum with higher reliability.

According to an eighth aspect of the present invention related to the seventh aspect of the present invention, the center of the inner circumference of the piston (22) is deviated from the center of the outer circumference of the piston (22) when viewed in plan.

According to the eighth aspect of the present invention, the piston (22) is fabricated easily by merely deviating the inner circumference center and the outer circumference center of the piston (22) from each other.

According to a ninth aspect of the present invention related to the second or third aspects of the present invention, the blade (23) and the piston (22) make relative swings at a predetermined swing center and the piston (22) is divided into four regions along the circumference thereof such that the piston (22) has narrow regions (W1, W3) and wide regions (W2, W4) formed in a continuous and alternate manner.

According to the ninth aspect of the present invention, the gap that occurs between the wall surface of the cylinder (21) and the wall surface of the piston (22) is surely reduced to a minimum at any time during the relative rotations by the cylinder (21) and the piston (22).

According to a tenth aspect of the present invention related to the first aspect of the present invention, part of the annular piston (22) of the rotation mechanism (20) is cut off such that the piston (22) is C-shaped, the blade (23) of the rotation mechanism (20) extends from the inner wall surface to the outer wall surface of the cylinder chamber (50) and passes through the cut-off portion of the piston (22) and a swing bushing is provided in the cut-off portion of the piston (22) to contact the piston (22) and the blade (23) via the surfaces thereof such that the blade (23) freely reciprocates and the blade (23) and the piston (22) make relative swings.

According to the tenth aspect of the present invention, the blade (23) reciprocates through the swing bushing (27) and the blade (23) swings together with the swing bushing (27) relative to the piston (22). Therefore, the cylinder (21) and the piston (22) make relative swings and rotations, whereby the rotation mechanism (20) achieves predetermined work such as compression.

Effect of the Invention

Thus, according to the present invention, at least any one of the width T1 of the cylinder chamber (50) and the width T2 of the piston (22) is varied along the circumference thereof. Therefore, the gap between the cylinder (21) and the piston (22) is kept uniform during a single rotation. As a result, in the outer and inner working chambers (51) and (52), refrigerant leakage from the high pressure region to the low pressure region is prevented. This brings about an improvement in efficiency.

According to the fourth aspect of the present invention, the width T1 of part of the cylinder chamber (50) ranging from the starting point to a point at a rotation angle of 180° from the starting point is large and the width T1 of the other part of the cylinder chamber (50) ranging from the 180° point to a point at a rotation less than 360° from the starting point is small. Further, according to the seventh aspect of the present invention, the width T2 of part of the piston (22) ranging from the starting point to a point at a rotation angle of 180° from the starting point is small and the width T2 of the other part of the piston (22) ranging from the 180° point to a point at a rotation angle of 360° from the starting point is large. Therefore, the refrigerant leakage is surely prevented at any time during a single rotation. This brings about an improvement in efficiency with reliability.

According to the fifth aspect of the present invention, the center of the inner circumference of the cylinder chamber (50) is deviated from the center of the outer circumference of the cylinder chamber (50) when viewed in plan. Further, according to the eighth aspect of the present invention, the center of the inner circumference of the piston (22) is deviated from the center of the outer circumference of the piston (22) when viewed in plan. Therefore, the width T1 of the cylinder chamber (50) is easily varied, and so is the width T2 of the piston (22).

According to the sixth aspect of the present invention, the cylinder chamber (50) is divided into four regions along the circumference thereof such that the cylinder chamber (50) has wide regions (Z1, Z3) and narrow regions (Z2, Z4) formed in a continuous and alternate manner. Further, according to the ninth aspect of the present invention, the piston (22) is divided into four regions along the circumference thereof such that the piston (22) has narrow regions (W1, W3) and wide regions (W2, W4) formed in a continuous and alternate manner. Therefore, the gap that occurs between the wall surface of the cylinder (21) and the wall surface of the piston (22) is surely reduced to a minimum at any time during the relative rotations by the cylinder (21) and the piston (22).

According to the tenth aspect of the present invention, a swing bushing (27) is provided as a connector for connecting the piston (22) and the blade (23) and substantially contacts the piston (22) and the blade (23) via the surfaces thereof. Therefore, the piston (22) and the blade (23) are prevented from wearing away and seizing up at the contacting parts.

Further, since the swing bushing (27) is provided to contact the piston (22) and the blade (23) via the surfaces thereof, the contacting parts are sealed with reliability. Therefore, the refrigerant leakage from the compression chamber (51) and the expansion chamber (52) is surely prevented, thereby preventing a decrease in compression efficiency and expansion efficiency.

Moreover, as the blade (23) is configured as an integral part of the cylinder (21) and supported by the cylinder (21) at both ends thereof, the blade (23) is less likely to receive abnormal concentrated load and stress concentration is less likely to occur during operation. Therefore, the sliding parts are less prone to be damaged, thereby improving the reliability of the mechanism.

DETAILED DESCRIPTION OF THE INVENTION

Hereinafter, embodiments of the present invention will be described in detail with reference to the drawings.

First Embodiment

Figure 1:
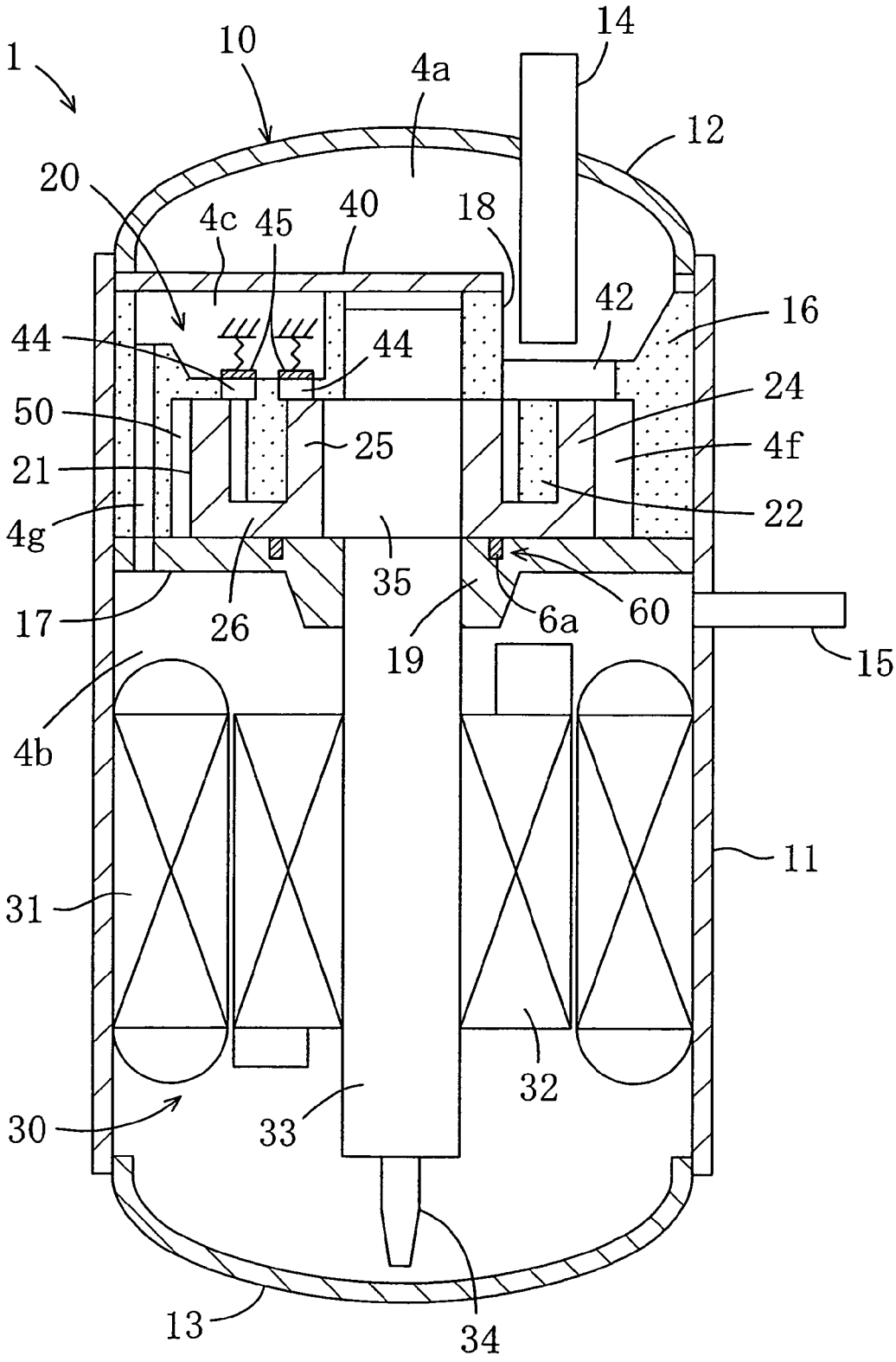
FIG. 1 is a vertical cross section of a compressor according to a first embodiment of the present invention.
Figure 2:
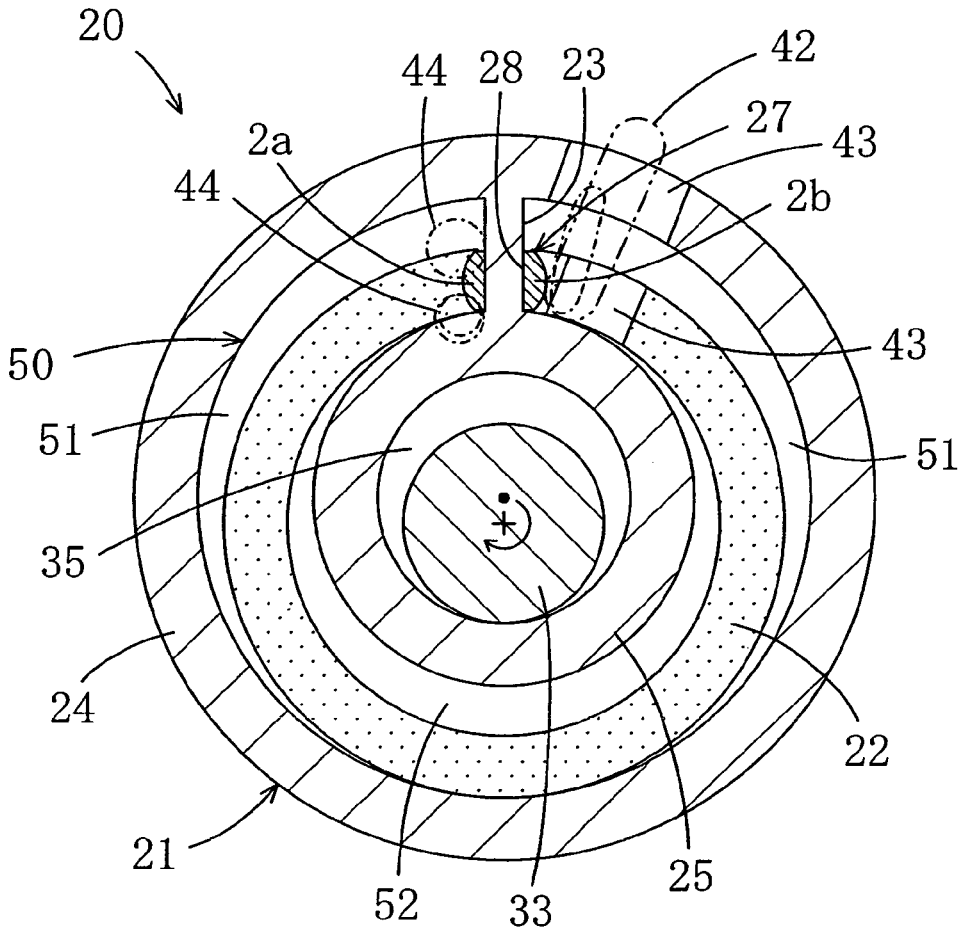
FIG. 2 is a horizontal cross section of the compressor.

In the present embodiment, the present invention is applied to a compressor (1) as shown in FIGS. 1 to 3. The compressor (1) is provided in a refrigerant circuit, for example.

The refrigerant circuit is configured to perform as at least cooling or heating. Specifically, the refrigerant circuit includes, an exterior heat exchanger serving as a heat source-side heat exchanger, an expansion valve serving as an expansion mechanism and an interior heat exchanger serving as a use-side heat exchanger which are connected in this order to the compressor (1). A refrigerant compressed by the compressor (1) releases heat in the exterior heat exchanger and expands at the expansion valve. Then, the expanded refrigerant absorbs heat in the interior heat exchanger and returns to the compressor (1). By repeating the circulation in this manner, the room air is cooled in the interior heat exchanger.

The compressor (1) is a completely hermetic rotary fluid machine including a compressor mechanism (20) and a motor (30) contained in a casing (10).

The casing (10) includes a cylindrical barrel (11), a top end plate (12) fixed to the top end of the barrel (11) and a bottom end plate (13) fixed to the bottom end of the barrel (11). A suction pipe (14) penetrates the top end plate (12) and is connected to the interior heat exchanger. A discharge pipe (15) penetrates the barrel (11) and is connected to the exterior heat exchanger.

The motor (30) is a drive mechanism and includes a stator (31) and a rotor (32). The stator (31) is arranged below the compressor mechanism (20) and fixed to the barrel (11) of the casing (10). A drive shaft (33) is connected to the rotor (32) such that the drive shaft (33) rotates together with the rotor (32).

The drive shaft (33) has a lubrication path (not shown) extending within the drive shaft (33) in the axial direction. At the bottom end of the drive shaft (33), a lubrication pump (34) is provided. The lubrication path extends upward from the lubrication pump (34) such that lubricating oil accumulated in the bottom of the casing (10) is supplied to sliding parts of the compressor mechanism (20) through the lubrication pump (34).

The drive shaft (33) includes an eccentric part (35) at the upper part thereof. The eccentric part (35) is larger in diameter than the other parts of the drive shaft above and below the eccentric part (35) and deviated from the center of the drive shaft (33) by a certain amount.

The compressor mechanism (20) is a rotation mechanism provided between a top housing (16) and a bottom housing (17) which are fixed to the casing (10).

The compressor mechanism (20) includes a cylinder (21) having an annular cylinder chamber (50), an annular piston (22) which is contained in the cylinder chamber (50) and divides the cylinder chamber (50) into an outer compressor chamber (51) and an inner compressor chamber (52) and a blade (23) which divides each of the outer and inner compression chambers (51) and (52) into a high pressure region and a low pressure region as shown in FIG. 2. The piston (22) in the cylinder chamber (50) is configured such that eccentric rotations are made relative to the cylinder (21). Specifically, relative eccentric rotations are made by the piston (22) and the cylinder (21). In the first embodiment, the cylinder (21) having the cylinder chamber (50) is a moving one of co-operating parts and the piston (22) contained in the cylinder chamber (50) is a stationary one of the co-operating parts.

The cylinder (21) includes an outer cylinder (24) and an inner cylinder (25). The outer and inner cylinders (24) and (25) are connected in one piece at the bottom by an end plate (26). The inner cylinder (25) is slidably fitted around the eccentric part (35) of the drive shaft (33). That is, the drive shaft (33) penetrates the cylinder chamber (50) in the vertical direction.

The piston (22) is integrated with the top housing (16). The top and bottom housings (16) and (17) are provided with bearings (18) and (19) for supporting the drive shaft (33), respectively. Thus, in the compressor (1) of the present embodiment, the drive shaft (33) penetrates the cylinder chamber (50) in the vertical direction and parts of the drive shaft sandwiching the eccentric part (35) in the axial direction are supported by the casing (10) via the bearings (18) and (19).

The compressor mechanism (20) includes a swing bushing (27) for connecting the piston (22) and the blade (23) in a movable manner. The piston (22) is in the form of a ring partially cut off, i.e., C-shaped. The blade (23) is configured to extend from the inner wall surface to the outer wall surface of the cylinder chamber (50) in the direction of the radius of the cylinder chamber (50) to pass through the cut-off portion of the piston (22) and fixed to the outer and inner cylinders (24) and (25). The swing bushing (27) serves as a connector for connecting the piston (22) and the blade (23) at the cut-off portion of the piston (22).

The inner circumference surface of the outer cylinder (24) and the outer circumference surface of the inner cylinder (25) are surfaces of concentric cylinders, respectively, and a single cylinder chamber (50) is formed between them. The outer circumference of the piston (22) yields a smaller diameter than the diameter given by the inner circumference of the outer cylinder (24), while the inner circumference of the piston (22) yields a larger diameter than the diameter given by the outer circumference of the inner cylinder (25). According to the structure, an outer compression chamber (51) as a working chamber is formed between the outer circumference surface of the piston (22) and the inner circumference surface of the outer cylinder (24) and an inner compression chamber (52) as a working chamber is formed between the inner circumference surface of the piston (22) and the outer circumference surface of the inner cylinder (25).

When the outer circumference surface of the piston (22) and the inner circumference surface of the outer cylinder (24) are substantially in contact with each other at a certain point (there is a micron-order gap between them in a strict sense, but refrigerant leakage from the gap is negligible), the inner circumference surface of the piston (22) and the outer circumference surface of the inner cylinder (25) come into contact with each other at a point having a phase 180° different from the certain point.

The swing bushing (27) includes a discharge-side bushing (2*a*) which is positioned closer to the discharge side than the blade (23) and a suction-side bushing (2*b*) which is positioned closer to the suction side than the blade (23). The discharge-side bushing (2*a*) and the suction-side bushing (2*b*) are in the same semicircle shape when viewed in section and arranged such that their flat surfaces face each other. Space between the discharge-side bushing (2*a*) and the suction-side bushing (2*b*) serves as a blade slit (28).

The blade (23) is inserted into the blade slit (28). The flat surfaces of the swing bushing (27) are substantially in contact with the blade (23). The arc-shaped outer circumference surfaces of the swing bushing (27) are substantially in contact with the piston (22). The swing bushing (27) is configured such that the blade (23) inserted in the blade slit (28) reciprocates in the direction of its surface within the blade slit (28). Further, the swing bushing (27) is configured to swing together with the blade (23) relative to the piston (22). Therefore, the swing bushing (27) is configured such that the blade (23) and the piston (22) can make relative swings at the center of the swing bushing (27) and the blade (23) can reciprocate relative to the piston (22) in the direction of the surface of the blade (23).

In the present embodiment, the discharge-side bushing (2*a*) and the suction-side bushing (2*b*) are separated. However, the bushings (2*a*) and (2*b*) may be connected at any part in one piece.

In the above-described structure, when the drive shaft (33) rotates, the blade (23) reciprocates within the blade slit (28) and the outer cylinder (24) and the inner cylinder (25) swing at the center of the swing bushing (27). According to the swing movement, the contact point between the piston (22) and the cylinder (21) is shifted in the order shown in FIGS. 3A to 3D. At this time, the outer and inner cylinders (24) and (25) go around the drive shaft (33) but do not spin by themselves.

The outer compressor chamber (51) outside the piston (22) decreases in volume in the order shown in FIGS. 3C, 3D, 3A and 3B. The inner compressor chamber (52) inside the piston (22) decreases in volume in the order shown in FIGS. 3A, 3B, 3C and 3D.

A top cover plate (40) is provided on the top housing (16). In the casing (10), space above the top cover plate (40) and the top housing (16) is defined as suction space (4*a*) and space below the bottom housing (17) is defined as discharge space (4*b*). An end of the suction pipe (14) is opened in the suction space (4*a*) and an end of the discharge pipe (15) is opened in the discharge space (4*b*).

A chamber (4*c*) is formed between the top housing (16) and the top cover plate (40).

The top housing (16) has a vertical hole (42) which penetrates the top housing (16) in the axial direction and has an opening facing the suction space (4*a*). The vertical hole (42) is elongated in shape in the radius direction. Between the top housing (16) and the bottom housing (17), a pocket (4*f*) is formed along the outer circumference surface of the outer cylinder (24). The pocket (4*f*) communicates with the suction space (4*a*) through the vertical hole (42) of the top housing (16). Therefore, the pressure in the atmosphere of the pocket (4*f*) is kept as low as the suction pressure.

Referring to FIG. 2, the vertical hole (42) of the top housing (16) is positioned at the right of the blade (23). Through the vertical hole (42) which is opened to the outer and inner compression chambers (51) and (52), the outer and inner compression chambers (51) and (52) communicate with the suction space (4*a*).

The outer cylinder (24) and the piston (22) have horizontal holes (43) penetrating in the radius direction, respectively. Referring to FIG. 2, the horizontal holes (43) are positioned at the right of the blade (23). The outer compression chamber (51) and the pocket (4*f*) communicate with each other through the horizontal hole (43) of the outer cylinder (24), whereby the outer compression chamber (51) communicates with the suction space (4*a*). Further, the inner compression chamber (52) and the outer compression chamber (51) communicate with each other through the horizontal hole (43) of the piston (22), whereby the inner compression chamber (52) communicates with the suction space (4*a*). The vertical hole (42) and the horizontal holes (43) serve as suction ports for a refrigerant. Only one of the vertical hole (43) and the horizontal holes (43) may be formed as the refrigerant suction port.

The top housing (16) has two discharge ports (44). The discharge ports (44) penetrate the top housing (16) in the axial direction. One of the discharge ports (44) faces the high pressure region of the outer compressor chamber (51) at one end and the other discharge port (44) faces the high pressure region of the inner compressor chamber (52) at one end. Specifically, the discharge ports (44) are formed near the blade (23) and positioned opposite to the vertical hole (42) relative to the blade (23). The other ends of the discharge ports (44) communicate with the chamber (4*c*). At the outside ends of the discharge ports (44), discharge valves (45) are provided as reed valves for opening/closing the discharge ports (44).

The chamber (4*c*) and the discharge space (4*b*) communicate with each other through a discharge path (4*g*) formed in the top and bottom housings (16) and (17).

The bottom housing (17) has a seal ring (6*a*). The seal ring (6*a*) is fitted in an annular groove formed in the bottom housing (17) and press-fitted to the bottom surface of the end plate (26) of the cylinder (21). At the interface between the cylinder (21) and the bottom housing (17) inside the seal ring (6*a*), high-pressure lubricating oil is supplied. With this structure, the seal ring (6*a*) serves as a compliance mechanism (60) for adjusting the position of the cylinder (21) in the axial direction, thereby reducing the gap that occurs in the axial direction from the top housing (16) to the piston (22) and the cylinder (21).

Figure 4:
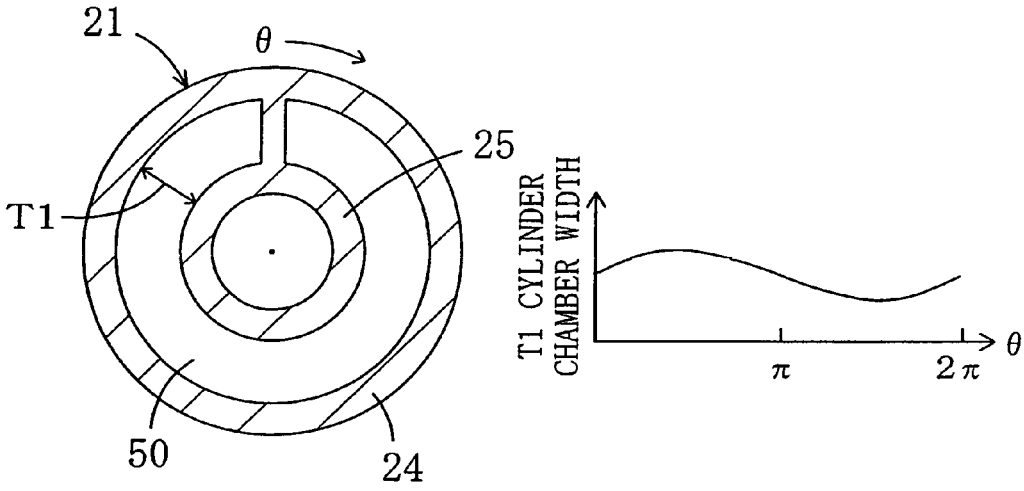
FIG. 4A is a horizontal cross section of a cylinder and FIG. 4B is a graph illustrating the variation in the width of a cylinder chamber.

As shown in FIG. 4, the width T1 of the cylinder chamber (50) is varied along the circumference of the cylinder chamber (50) such that the gap between the wall surface of the cylinder (21) and the wall surface of the piston (22) is kept to a predetermined value during the rotations.

Further, the width T2 of the piston (22) is also varied along the circumference of the piston (22) such that the gap between the wall surface of the cylinder (21) and the wall surface of the piston (22) is kept to a predetermined value during the rotations.

Regarding the center line of the blade (23) as a starting point of the circumference of the cylinder chamber (50), the width T1 of part of the cylinder chamber (50) ranging from the starting point to a point at a rotation angle of 180° from the starting point is large and the width T1 of the other part of the cylinder chamber (50) ranging from the 180° point to the point at a rotation angle less than 360° from the starting point is small. More specifically, when viewed in plan, the center of the inner circumference of the cylinder chamber (50) is deviated from the center of the outer circumference of the cylinder chamber (50). That is, the center of the inner circumference of the cylinder chamber (50) is shifted from the center of the outer circumference toward the direction of a rotation angle of 270° from the starting point. As a result, the width T1 of the cylinder chamber (50) increases from a point at a rotation angle of 0° and reaches the maximum at a point at a rotation angle of 90°. Then, the width T1 of the cylinder chamber (50) gradually decreases as the rotation angle increases and reaches the minimum at a point at a rotation angle of 270°. Again, the width T1 of the cylinder chamber (50) gradually increases from the point at a rotation angle of 270° to the point at a rotation angle of 0°.

It is preferable that the width T1 of part of the cylinder chamber (50) ranging from a point at a rotation angle of 70° to a point at a rotation angle of 160° is large and the width T1 of the other part of the cylinder chamber (50) ranging from a point at a rotation angle of 250° to a point at a rotation angle of 340° is small.

As to the width T2 of the piston (22), regarding the swing center of the blade (23) and the piston (22) as a starting point of the circumference of the piston (22), the width T2 of part of the piston (22) ranging from the starting point to a point at a rotation angle of 180° from the starting point is small and the width T2 of the other part of the piston (22) ranging from the 180° point to a point at a rotation angle less than 360° from the starting point is large. More specifically, when viewed in plan, the center of the outer circumference of the piston (22) is deviated from the center of the inner circumference of the piston (22). That is, the center of the outer circumference of the piston (22) is shifted from the center of the inner circumference toward the direction of a rotation angle of 270° from the starting point. As a result, the width T2 of the piston (22) decreases from a point at a rotation angle of 0° and reaches the minimum at a point at a rotation angle of 90°. Then, the width T2 of the piston (22) gradually increases as the rotation angle increases and reaches the maximum at a point at a rotation angle of 270°. Again, the width T2 of the piston (22) gradually decreases from the point at a rotation angle of 270° to the point at a rotation angle of 0°.

It is preferable that the width T2 of part of the piston (22) ranging from a point at a rotation angle of 70° to a point at a rotation angle of 160° is small and the width T2 of the other part of the piston (22) ranging from a point at a rotation angle of 250° to a point at a rotation angle of 340° is large.

Hereinafter, an explanation of a basic principle why the width T1 of the cylinder chamber (50) and the width T2 of the piston (22) are varied will be provided.

As shown in FIGS. 6A to 6D, a refrigerant pressure, i.e., the direction of application of a gas load varies while the cylinder (21) makes a single rotation. In FIGS. 6A to 6D, the shaft center of the drive shaft is regarded as the center, the swing center of the piston (22) (the center of the blade) is regarded as a Y-axis and a line orthogonal to the Y-axis is regarded as an X-axis.

Figure 6A:
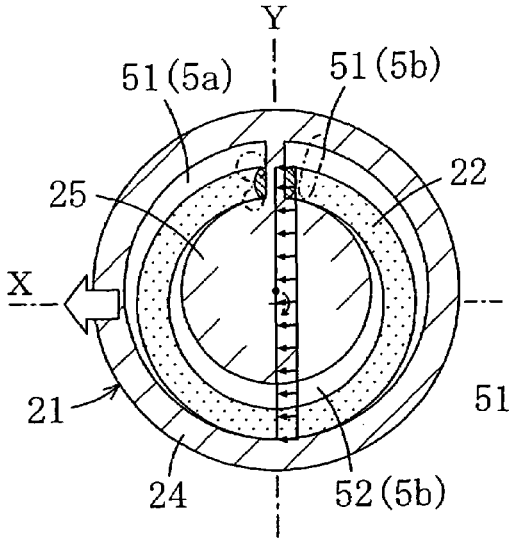
FIGS. 6A to 6D are horizontal cross sections illustrating the direction of application of a gas load while the compressor is working.

First, referring to FIG. 6A, the piston (22) is at the bottom dead center. In this state, the outer compressor chamber (51) is divided into a suction-side low pressure chamber (5*b*) and a discharge-side high pressure chamber (5*a*), while the inner compressor chamber (52) functions as a single low pressure chamber (5*b*) which is at a suction pressure. Therefore, only a gas load of the high pressure chamber (5*a*) of the outer compressor chamber (51) is applied to the cylinder (21) and the piston (22) toward the projection plane of the cylinder chamber (50). The gas load is applied in the X direction, i.e., to the left in FIG. 6A.

Figure 6D:
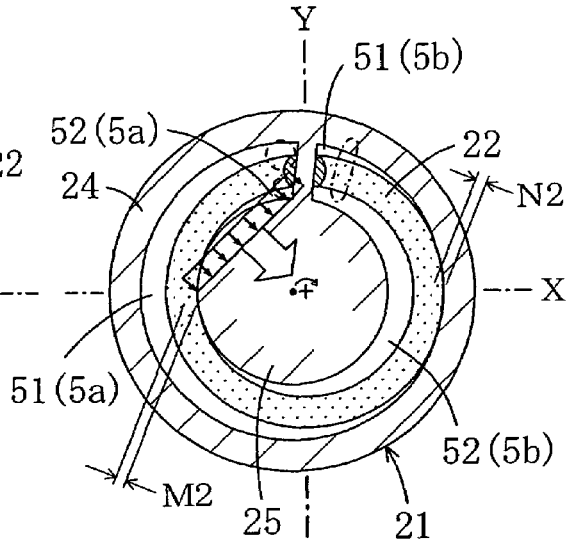
Figure 6B:
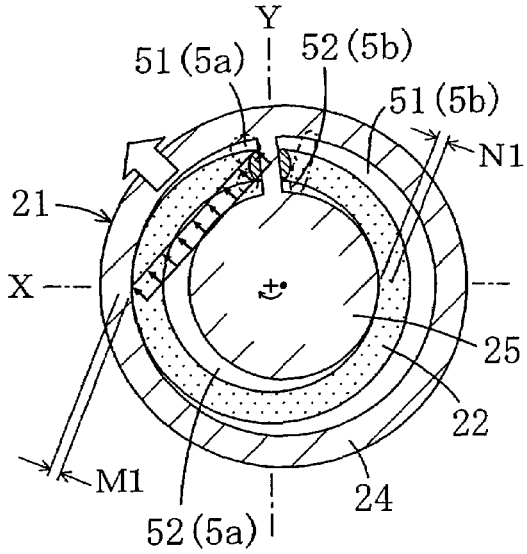

Then, the cylinder (21) rotates 90° to enter the state shown in FIG. 6B, the low pressure chamber (5*b*) of the outer pressure chamber (51) increases in volume, thereby decreasing the volume of the high pressure chamber (5*a*). The inner compressor chamber (52) is divided into a suction-side low pressure chamber (5*b*) and a discharge-side high pressure chamber (5*a*) and compression occurs in the high pressure chamber (5*a*) and suction occurs in the low pressure chamber (5*b*). Therefore, a gas load of the high pressure chambers (5*a*) of the outer and inner compression chambers (51) and (52) is applied to the cylinder (21) and the piston (22) toward the projection plane of the cylinder chamber (50). The gas load is applied in the direction rotated 45° from the X-axis, i.e., to the upper left in FIG. 6B. In this case, the outer cylinder (24) and the piston (22) approach at the left end along the X-axis. As the cylinder (21) is pressed to the direction of application of the gas load, a gap M1 between the outer cylinder (24) and the piston (22) increases, while a gap N1 between the inner cylinder (25) and the piston (22) increases at the right end along the X-axis.

Figure 6C:
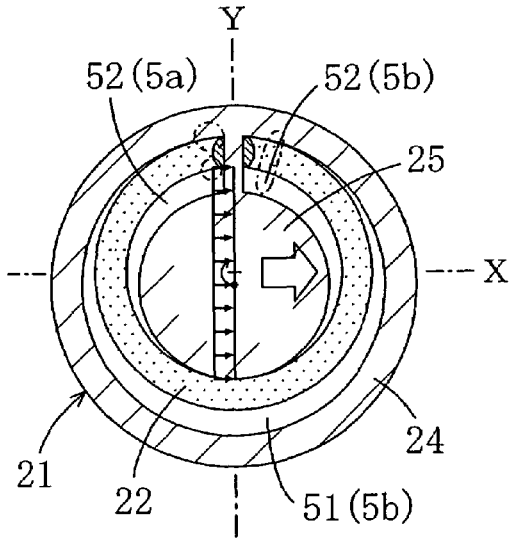

As the cylinder (21) further rotates 90° to enter the state shown in FIG. 6C, the piston (22) comes to the top dead center. At the top dead center, the inner compressor chamber (52) is divided into a suction-side low pressure chamber (5*b*) and a discharge-side high pressure chamber (5*a*). The outer compression chamber (51) functions as a single low pressure chamber (5*b*) which is at a suction pressure. Therefore, only a gas load of the high pressure chamber (5*a*) of the inner compressor chamber (52) is applied to the cylinder (21) and the piston (22) toward the projection plane of the cylinder chamber (50). The gas load is applied in the X-axis direction, i.e., to the right in FIG. 6C.

Then, as the cylinder (21) further rotates 90° to enter the state shown in FIG. 6D, the low pressure chamber (5*b*) of the inner compressor chamber (52) increases in volume, thereby decreasing the volume of the high pressure chamber (5*a*). The outer compressor chamber (51) is divided into a suction-side low pressure chamber (5*b*) and a discharge-side high pressure chamber (5*a*) and compression occurs in the high pressure chamber (5*a*) and suction occurs in the low pressure chamber (5*b*). Therefore, a gas load of the high pressure chambers (5*a*) of the outer and inner compressor chambers (51) and (52) is applied to the cylinder (21) and the piston (22) toward the projection plane of the cylinder chamber (50). The gas load is applied in the direction rotated 45° from the X-axis, i.e., to the lower right in FIG. 6D. In this case, the inner cylinder (25) and the piston (22) approach at the left end along the X-axis. As the cylinder (21) is pressed to the direction of application of the gas load, a gap M2 between the inner cylinder (25) and the piston (22) increases and a gap N2 between the outer cylinder (24) and the piston (22) increases at the right end along the X-axis.

Figure 5:
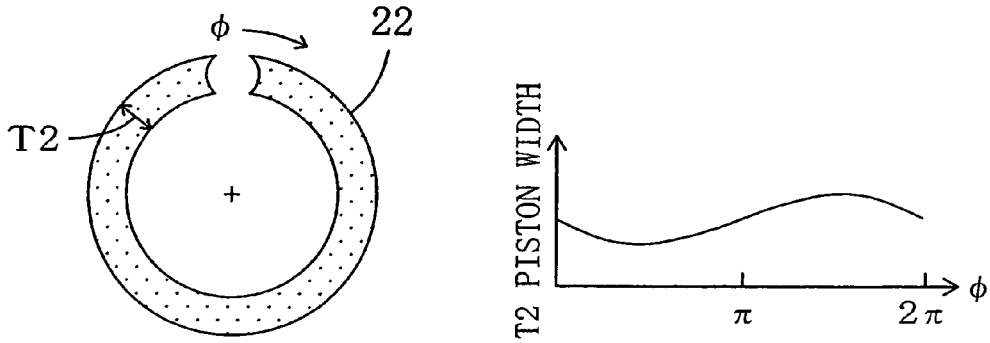
FIG. 5A is a horizontal cross section of a piston and FIG. 5B is a graph illustrating the variation in the width of the piston.

As described above, it is preferred that the center of the inner circumference of the cylinder chamber (50) is shifted from the center of the outer circumference thereof in the direction of a rotation angle of 270° such that the width T1 of part of the cylinder chamber (50) at a rotation angle of 90° becomes the largest and the width T1 of part of the cylinder chamber (50) at a rotation angle of 270° becomes the smallest. Further, it is preferred that the center of the outer circumference of the piston (22) is shifted from the center of the inner circumference thereof in the direction of a rotation angle of 270° such that the width T2 of part of the piston (22)

at a rotation angle of 90° becomes the smallest and the width T2 of part of the piston (22) at a rotation angle of 270° becomes the largest. As a result, the gaps M1 and M2 decrease. For these reasons described above, the widths T1 and T2 of the cylinder chamber (50) and the piston (22) are determined as shown in FIGS. 4 and 5.

—Operation—

Next, an explanation of how the compressor (1) works is provided.

When the motor (30) is actuated, the rotation of the rotor (32) is transferred to the outer and inner cylinders (24) and (25) of the compressor mechanism (20) via the drive shaft (33). Then, in the compressor mechanism (20), the blade (23) reciprocates through the swing bushing (27), while the blade (23) and the swing bushing (27) swing together relative to the piston (22). As a result, the outer and inner cylinders (24) and (25) swing and go around the piston (22), whereby the compressor mechanism (20) performs compression as required.

Figure 3A:
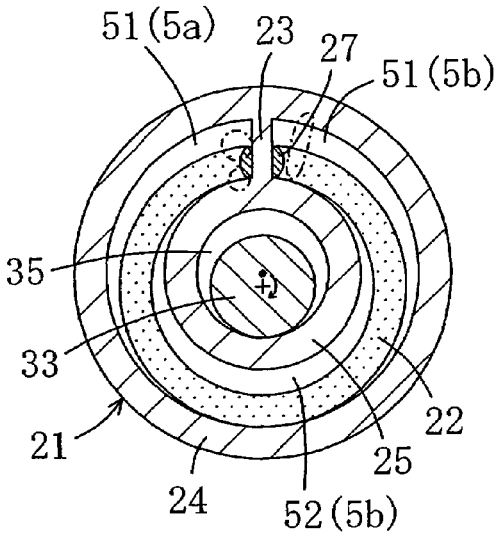
FIGS. 3A to 3D are horizontal cross sections illustrating how the compressor works.
Figure 3D:
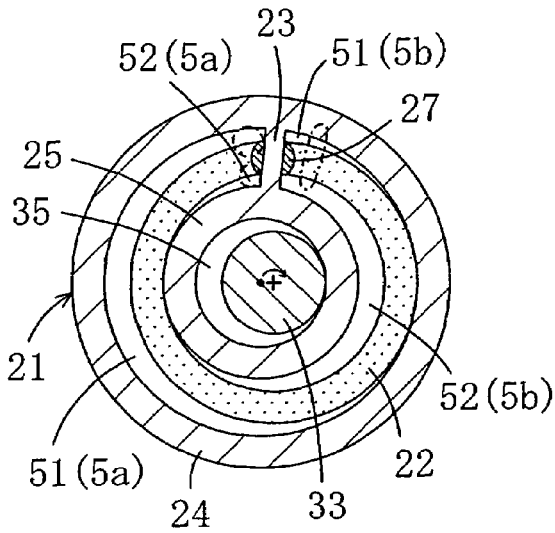
Figure 3B:
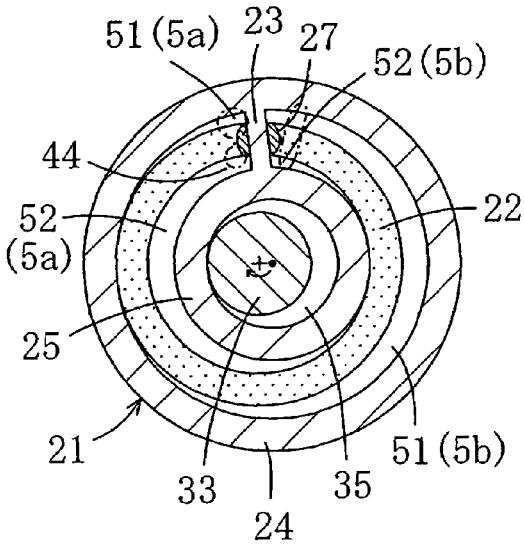
Figure 3C:
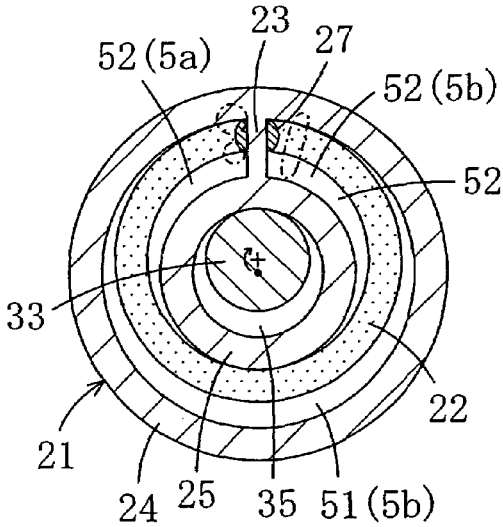

Specifically, when the drive shaft (33) rotates to the right while the piston (22) is at the top dead center as shown in FIG. 3C, suction starts in the outer compression chamber (51). As the state of the compressor mechanism (20) changes in the order shown in FIGS. 3D, 3A and 3B, the outer compressor chamber (51) increases in volume and the refrigerant is sucked therein through the vertical hole (42) and the horizontal holes (43).

When the piston (22) is at the top dead center as shown in FIG. 3C, the outer compressor chamber (51) forms a single chamber outside the piston (22). In this state, the volume of the outer compressor chamber (51) is substantially the maximum. Then, as the drive shaft (33) rotates to the right to change the state of the compressor mechanism (20) in the order shown in FIGS. 3D, 3A and 3B, the outer compressor chamber (51) decreases in volume and the refrigerant therein is compressed. When the pressure in the outer compressor chamber (51) reaches a predetermined value and the differential pressure between the outer compressor chamber (51) and the discharge space (4*b*) reaches a specified value, the discharge valves (45) are opened by the high pressure refrigerant in the outer compressor chamber (51). Thus, the high pressure refrigerant is released from the discharge space (4*b*) into the discharge pipe (15).

In the inner compressor chamber (52), suction starts when the drive shaft (33) rotates to the right from the state where the piston (22) is at the bottom dead center as shown in FIG. 3A. As the state of the compressor mechanism (20) changes in the order shown in FIGS. 3B, 3C and 3D, the inner compressor chamber (52) increases in volume and the refrigerant is sucked therein through the vertical hole (42) and the horizontal holes (43).

When the piston (22) is at the bottom dead center as shown in FIG. 3A, the inner compressor chamber (51) forms a single chamber inside the piston (22). In this state, the volume of the inner compressor chamber (52) is substantially the maximum. Then, as the drive shaft (33) rotates to the right to change the state of the compressor mechanism (20) in the order shown in FIGS. 3B, 3C and 3D, the inner compressor chamber (52) decreases in volume and the refrigerant therein is compressed. When the pressure in the inner compressor chamber (52) reaches a predetermined value and the differential pressure between the inner compressor chamber (52) and the discharge space (4*b*) reaches a specified value, the discharge valves (45) are opened by the high pressure refrigerant in the inner compressor chamber (52). Thus, the high pressure refrigerant is released from the discharge space (4*b*) into the discharge pipe (15).

When the compressor mechanism (20) enters the state shown in FIG. 6B, the gap M1 between the outer cylinder (24) and the piston (22) approaching each other at the left end along the X-axis is likely to increase. At the same time, the gap N2 between the inner cylinder (25) and the piston (22) approaching each other at the right end along the X-axis is also likely to increase.

In the state shown in FIG. 6D, the gap M2 between the inner cylinder (25) and the piston (22) approaching each other at the left end along the X-axis is likely to increase. At the same time, the gap N2 between the outer cylinder (24) and the piston (22) approaching each other at the right end along the X-axis is also likely to increase.

The cylinder chamber (50) is configured such that the width T1 of part thereof at a rotation angle of 90° becomes the largest and the width T1 of part thereof at a rotation angle of 270° becomes the smallest, while the piston (22) is configured such that the width T2 of part thereof at a rotation angle of 90° becomes the smallest and the width T2 of part thereof at a rotation angle of 270° becomes the largest. Therefore, in a single rotation, the gaps M1 and M2 are reduced, thereby keeping the gap between the cylinder (21) and the piston (21) small.

—Effect of the First Embodiment—

According to the present embodiment described above, the width T1 of the cylinder chamber (50) is varied along the circumference thereof, and so is the width T2 of the piston (22). Therefore, the gap between the outer cylinder (24) and the piston (22), as well as the gap between the inner cylinder (25) and the piston (22), are kept uniform during a single rotation. As a result, in both of the outer and inner compressor chambers (51) and (52), refrigerant leakage from the high pressure region to the low pressure region is prevented. This brings about an improvement in efficiency.

In particular, the width T1 of part of the cylinder chamber (50) ranging from a starting point of the circumference of the cylinder chamber (50) to a point at a rotation angle of 180° from the starting point is set large and the width T1 of the other part of the cylinder chamber (50) ranging from the 180° point to a point at a rotation angle less than 360° from the starting point is set small. Further, the width T2 of part of the piston (22) ranging from a starting point of the circumference of the piston (22) to a point at a rotation angle of 180° from the starting point is set small and the width T2 of the other part of the piston (22) ranging from the 180° point to a point at a rotation angle of 360° is set large. Therefore, in a single rotation, the refrigerant leakage is surely prevented. This brings about an improvement in efficiency with reliability.

Further, as the cylinder chamber (50) is configured such that the center of the inner circumference is deviated from the center of the outer circumference when viewed in plan and the piston (22) is configured such that the center of the inner circumference is deviated from the center of the outer circumference when viewed in plan, the width T1 of the cylinder chamber (50) is easily varied, and so is the width T2 of the piston (22).

The swing bushing (27) is provided as a connector for connecting the piston (22) and the blade (23) such that the swing bushing (27) substantially contacts the piston (22) and the blade (23) via the surfaces thereof. Therefore, the piston (22) and the blade (23) are prevented from wearing away and seizing up at the contacting parts during operation.

As the swing bushing (27), piston (22) and blade (23) are in contact with each other via the surfaces thereof, the contacting parts are sealed with reliability. Therefore, the leakage of the refrigerant from the outer and inner compression chambers (51) and (52) are surely prevented, thereby preventing a decrease in compression efficiency.

Moreover, as the blade (23) is configured as an integral part of the cylinder (21) and supported by the cylinder (21) at both ends thereof, the blade (23) is less likely to receive abnormal concentrated load and stress concentration is less likely to occur during operation. Therefore, the sliding parts are less prone to be damaged, thereby improving the reliability of the mechanism.

Second Embodiment

Next, an explanation of a second embodiment of the present invention will be provided in detail with reference to the drawings.

In the first embodiment described above, the width T1 of the cylinder chamber (50) and the width T2 of the piston (22) are varied between two regions, respectively. However, in the present embodiment, the widths are varied among four regions as shown in FIGS. 7 to 9.

Specifically, the cylinder chamber (50) is divided into four regions along the circumference thereof such that the cylinder chamber (50) has wide regions (Z1, Z3) and narrow regions (Z2, Z4) formed in a continuous and alternate manner. Further, the piston (22) is also defined into four regions along the circumference thereof such that the piston (22) has narrow regions (W1, W3) and wide regions (W2, W4) formed in a continuous and alternate manner.

Figure 7:
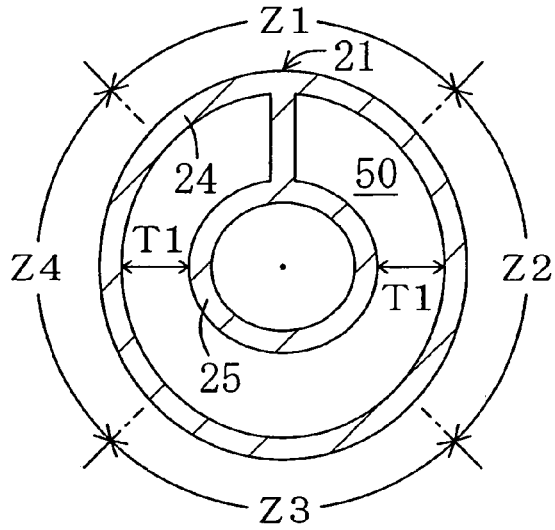
FIG. 7 is a horizontal cross section of a cylinder according to a second embodiment.

That is, as shown in FIG. 7, the cylinder chamber (50) includes a first region (Z1) having a center angle of 90° and including the blade (23) as the wide region (Z1). In the clockwise direction from the first region (Z1), a second region (Z2) as the narrow region (Z2), a third region (Z3) as the wide region (Z3) and a fourth region (Z4) as the narrow region (Z4) are formed in this order with a center angle of 90°, respectively.

Figure 8:
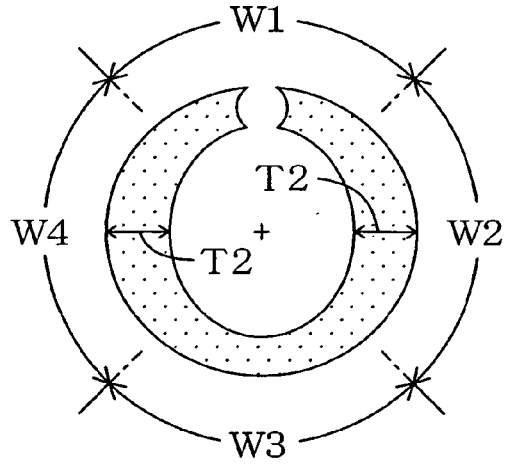
FIG. 8 is a horizontal cross section of a piston according to a second embodiment.
Figure 9:
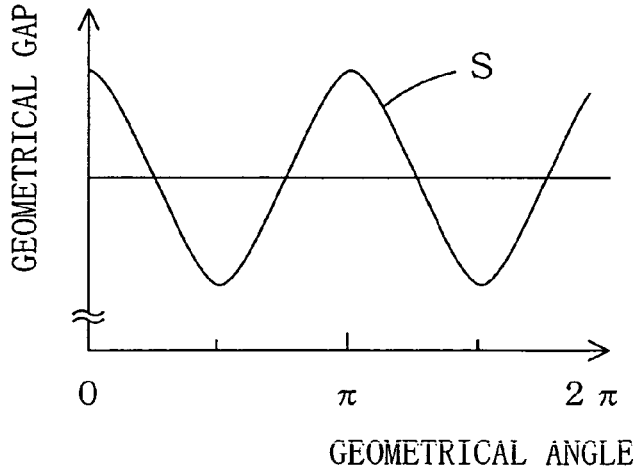
FIG. 9 is a graph illustrating the variation of a geometrical gap that occurs between the cylinder and the piston.

Further, as shown in FIG. 8, the piston (22) includes a first region (W1) having a center angle of 90° and including a cut-off portion for arranging the swing bushing (27) as a narrow region (W1). In the clockwise direction from the first region (W1), a second region (W2) as a wide region (W2), a third region (W3) as a narrow region (W3) and a fourth region (W4) as a wide region (W4) are formed in this order with a center angle of 90°, respectively.

A geometrical gap between the cylinder (21) and the piston (22) varies along the cosine curve S shown in FIG. 9. Specifically, the geometrical gap increases along the curve S because the gaps M1, N1, M2 and N2 increase in the states shown in FIGS. 6B and 6D.

Therefore, the cylinder chamber (50) is configured to have the wide regions (Z1, Z3) and the narrow regions (Z2, Z4) in an alternate manner. At the same time, the piston (22) is also configured to include the narrow regions (W1, W3) and wide regions (W2, W4) in an alternate manner to meet the wide regions (Z1, Z3) and the narrow regions (Z2, Z4) of the cylinder chamber (50).

As a result, at any time during the relative rotations by the cylinder (21) and the piston (22), the gap formed between the wall surface of the cylinder (21) and the wall surface of the piston (22) is surely reduced to a minimum.

Other Embodiments

The following variations may be added to the first and second embodiments of the present invention.

In the first and second embodiments, the width T1 of the cylinder chamber (50) is varied and the width T2 of the piston (22) is also varied. However, in a first invention, the width T1 of the cylinder chamber (50) may solely be varied. In a second invention, the width T2 of the piston (22) may solely be varied.

According to the present invention, the cylinder (21) may be a stationary part and the piston (22) may be a moving part.

The outer and inner cylinders (24) and (25) of the cylinder (21) may be integrated at the top end with the plate (26) and the piston (22) may be integral with the bottom housing (17).

According to the first invention, the piston (22) may be in the form of a complete ring without being cut off. In such a case, the blade (23) is divided into an outer blade (23) and an inner blade (23) such that the outer blade (23) extends from the outer cylinder (21) to contact the piston (22) while the inner blade (23) extends from the inner cylinder (21) to contact the piston (22).

It should be understood that the rotary fluid machine of the present invention is applicable not only to the compressor but also to an expansion apparatus for expanding a refrigerant or a pump.

INDUSTRIAL APPLICABILITY

As described above, the present invention is useful as a rotary fluid machine including an outer working chamber and an inner working chamber.

What is claimed is:

1. A rotary fluid machine comprising:

a cylinder having an annular cylinder chamber formed as a space between a cylindrical inner periphery and a cylindrical outer periphery of the annular cylinder chamber;

an annular piston disposed in the cylinder chamber to be eccentric to the cylinder, the annular piston dividing the cylinder chamber into an outer working chamber and an inner working chamber, the annular piston having a cylindrical inner piston surface facing the inner periphery of the cylinder chamber and a cylindrical outer piston surface facing the outer periphery of the cylinder chamber; and a blade arranged in the cylinder chamber, the blade extending in a radius direction from the outer periphery to the inner periphery of the cylinder chamber to divide each of the outer and inner working chambers into a high pressure region and a low pressure region, the cylinder and the piston making relative rotations, the cylinder chamber having a radial width measured between the inner and outer peripheries of the cylinder chamber that is varied about a circumference of the cylinder chamber such that a gap between the inner periphery of the cylinder chamber and the inner piston surface of the piston and a gap between the outer periphery of the cylinder chamber and the outer piston surface of the piston are kept substantially smallest during a full rotation, with a difference in fluid pressure between the outer working chamber and the inner working chamber taking place in the full rotation.

2. A rotary fluid machine comprising:

a cylinder having an annular cylinder chamber formed as a space between a cylindrical inner periphery and a cylindrical outer periphery of the annular cylinder chamber;

an annular piston disposed in the cylinder chamber to be eccentric relative to the cylinder, the annular piston dividing the cylinder chamber into an outer working chamber and an inner working chamber, the annular piston having a cylindrical inner piston surface facing the inner periphery of the cylinder chamber and a cylindrical outer piston surface facing the outer periphery of the cylinder chamber; and a blade arranged in the cylinder chamber, the blade extending in a radius direction from the outer periphery to the inner periphery of the cylinder chamber to divide each of the outer and inner working chambers into a high pressure region and a low pressure region, the cylinder and the piston making relative rotations without spinning by themselves, the piston having a radial width measured between the inner and outer piston surfaces that is varied about a circumference of the piston such that a gap between the inner periphery of the cylinder chamber and the inner piston surface of the piston and a gap between the outer periphery of the cylinder chamber and the outer piston surface of the piston are kept substantially smallest during a full rotation, with a difference in fluid pressure between the outer working chamber and the inner working chamber taking place in the full rotation.

3. The rotary fluid machine according to claim 2, wherein the cylinder chamber has a width that is varied along a circumference of the cylinder chamber such that the gap between the wall surface of the cylinder and the wall surface of the piston is kept to a predetermined value during the rotations.

4. The rotary fluid machine according to claim 3, wherein the blade has a center line that is a starting point of the circumference of the cylinder chamber, a width of a part of the cylinder chamber ranging from the starting point to a point at a rotation angle of 180° from the starting point is larger than a width of another part of the cylinder chamber ranging from the 180° point to a point at a rotation angle less than 360° from the starting point.

5. The rotary fluid machine according to claim 4, wherein a center of an inner circumference of the cylinder chamber is deviated from a center of the outer circumference of the cylinder chamber when viewed along a longitudinal axis of the cylinder chamber.

6. The rotary fluid machine according to claim 3, wherein the cylinder chamber is divided into four regions about the circumference thereof such that the cylinder chamber has regions that are wider than other regions formed in a continuous and alternate manner therebetween.

7. The rotary fluid machine according to claim 2, wherein the piston and the blade make relative swings at a predetermined swing center, and the swing center of the blade and the piston is a starting point of the circumference of the piston, a width of a part of the piston ranging from the starting point to a point at a rotation angle of 180° from the starting point is smaller than a width of another part of the piston ranging from the 180° point to a point at a rotation angle of 360° from the starting point.

8. The rotary fluid machine according to claim 7, wherein a center of an inner circumference of the piston is deviated from a center of the outer circumference of the piston when viewed along a longitudinal axis of the piston.

9. The rotary fluid machine according to claim 2, wherein the piston and the blade make relative swings at a predetermined swing center and the piston is divided into four regions about the circumference thereof such that the piston has two regions that are narrower than two other regions formed in a continuous and alternate manner therebetween.

10. The rotary fluid machine according to claim 1, wherein the annular piston is C-shaped to form a gap, the blade extends from an inner wall surface to an outer wall surface of the cylinder chamber and passes through the gap of the piston, and a swing bushing is provided in the gap of the piston to contact the piston and the blade via the surfaces thereof such that the blade freely reciprocates and the blade and the piston make relative swings.

11. The rotary fluid machine according to claim 1, wherein the blade has a center line that is a starting point of the circumference of the cylinder chamber, a width of a part of the cylinder chamber ranging from the starting point to a point at a rotation angle of 180° from the starting point is larger than a width of another part of the cylinder chamber ranging from the 180° point to a point at a rotation angle less than 360° from the starting point.

12. The rotary fluid machine according to claim 11, wherein a center of an inner circumference of the cylinder chamber is deviated from a center of the outer circumference of the cylinder chamber when viewed along a longitudinal axis of the cylinder chamber.

13. The rotary fluid machine according to claim 3, wherein the cylinder chamber is divided into four regions about the circumference thereof such that the cylinder chamber has two regions that are wider than two other regions formed in a continuous and alternate manner therebetween.

14. The rotary fluid machine according to claim 3, wherein the piston and the blade make relative swings at a predetermined swing center, and the swing center of the blade and the piston is a starting point of the circumference of the piston, a width of a part of the piston ranging from the starting point to a point at a rotation angle of 180° from the starting point is smaller than a width of another part of the piston ranging from the 180° point to a point at a rotation angle of 360° from the starting point.

15. The rotary fluid machine according to claim 14, wherein a center of an inner circumference of the piston is deviated from a center of the outer circumference of the piston when viewed along a longitudinal axis of the piston.

16. The rotary fluid machine according to claim 3, wherein the piston and the blade make relative swings at a predetermined swing center, and the piston is divided into four regions about the circumference thereof such that the piston has two regions that are narrower than two other regions formed in a continuous and alternate manner therebetween.

* * * * *